US005377606A

United States Patent [19]

Fujita

[11] Patent Number: 5,377,606

[45] Date of Patent: Jan. 3, 1995

[54] THREAD TENSIONING DEVICE FOR SEWING MACHINE

[75] Inventor: Shuji Fujita, Chofu, Japan

[73] Assignee: Juki Corporation, Chofu, Japan

[21] Appl. No.: 53,882

[22] Filed: Apr. 27, 1993

[30] Foreign Application Priority Data

Apr. 27, 1992 [JP] Japan ..... 4-027623[U]

[51] Int. Cl.[6] ..... D05B 47/00

[52] U.S. Cl. ..... 112/254; 242/150 R

[58] Field of Search ..... 112/254, 255; 242/150 R

[56] References Cited

U.S. PATENT DOCUMENTS

| | | | |
|---|---|---|---|
| 2,937,605 | 5/1960 | Dunn et al. | 112/254 |
| 2,955,775 | 10/1960 | Johnson | 112/254 x |
| 3,150,846 | 9/1964 | Laidig | 112/254 x |
| 4,611,547 | 9/1986 | Kuramoto | 112/254 |
| 5,156,105 | 10/1992 | Wang | 112/254 |
| 5,211,122 | 5/1993 | Lin | 112/254 |
| 5,216,970 | 6/1993 | Sakuma | 112/254 X |

FOREIGN PATENT DOCUMENTS 1115474 8/1989 Japan .

*Primary Examiner*—Clifford D. Crowder
*Assistant Examiner*—Paul C. Lewis
*Attorney, Agent, or Firm*—Morgan & Finnegan

[57] ABSTRACT

A thread tension device for overlock sewing machines, which provides a thread tensioner and a regulator. The thread tensioner includes a pair of thread tensioning discs supported on a rotatable shaft and slidably movable axially on said shaft and a spring having one end supported on a spring holder threadably movable on a sleeve and the other end abutted against one of the thread tensioning plates. The regulator includes a rotary member fixed to the shaft and rotatably driven with the shaft; and a follower having one side held against the rotary member and the other side abutted against the other one of the thread tensioning plates over the spring.

3 Claims, 4 Drawing Sheets

THREAD TENSIONING DEVICE FOR SEWING MACHINE

BACKGROUND OF THE INVENTION

This invention relates to a thread tension device for sewing machines such as an overlock sewing machine and the like. More particularly, the invention relates to a thread tension regulating mechanism which is capable of regulating or controlling energizeable force applied to threads in response to changes in the shapes of stitches to be formed so that the threads may be suitably adjusted for sewing operations.

FIG. 4 shows a perspective view of a conventional overlock sewing machine provided with a plurality of spool holders 1 (four spool holders in this instance). The spool holders are arranged to unwind the respective threads in such a manner that they intersect each other to form an overedge stitch, a roll hemming stitch, and an ornamental stitch or the like.

Generally, the overlock sewing machine varies tension on a plurality of the threads through resistance to movement whenever changes in the shape of stitches are made. In order to correspond to such changes in tension on the threads, the overlock sewing machine is normally provided with thread tension devices 2, each engaging each thread and applying a tensile force thereto. FIG. 5 is a sectional view showing the details of the thread tension device. For the purpose of illustration, only one thread tension device 2 is shown, although four thread tension devices are actually mounted as to correspond to four threads. A thread tension dial 3 is mounted on the frame of the sewing machine to rotate a shaft 4. A pair of thread tension discs 5 are so supported on the shaft as to be slidably movable axially on the shaft 4 but are prevented by a stationary member 10 fixed to the shaft 4 from being moved in a direction opposite thread tension dial 3 because the thread tension discs 5 abut against the stationary member 10. A slider member 6 is also supported on the shaft so as to be slidably movable axially on the shaft 4 and is provided at one end thereof with a pin P. A cam 8 is secured to the shaft 4 and rotated therewith. A cam groove 9 is obliquely formed in the cam 8 to receive the pin P of the slider member 6.

A spring B is mounted over the shaft 4 and adapted to abut its one end against the thread tension discs 5 and the other end against the slider member 6. Although only one thread tension device is shown for the purpose of better illustration, a plurality of the thread tension devices may be mounted on the shaft 4 and provided with corresponding cams 8 having cam grooves 9 which are configured different from each other to apply the optimum tensile force to the tension devices and to the threads.

According to the thread tension device arranged as aforesaid, rotation of the thread tension dial 3 rotates the cam 8 causing the cam groove 9 to axially move the slider member 6. Upon movement of the slider member 6, the spring B is caused to vary energy force to the thread tension discs 5, thereby varying tension through resistance to movement of the thread clamped between the tension discs.

The conventional tension regulating device has the following problems. The thread tension device for the overlock sewing machine shown in FIG. 5 is arranged so as to be movable by a pin P outwardly extended from the slider 6 and a cam groove 9 in which the pin P is received so that a contact surface 7 defined by the slider 6 and the shaft is elongated. In other words, if the contact surface is narrowed, the slider member 6 is tilted when moved to thus prevent it from being smoothly moved. For this reason, the thread tension device shown in FIG. 5 is designed so that the slider 6 is made longitudinally and axially of the shaft 4 and is thus elongated as a whole. Thus, the overlock sewing machine is inevitably made wider as seen from FIG. 4 and has resulted in the massive sewing machine. Furthermore, great force is required to move a plurality of the sliders 6 so that manipulating the thread tension device is difficult, particularly, rotating the thread tension dial 3 by the pin P extending therefrom and the cam groove 9. This requires the shaft 4 to provide an axially longitudinal contact surface to have the slider member 6 contacted therewith.

SUMMARY OF THE INVENTION

It is an object of the present invention to overcome the disadvantages of the prior art.

A primary object of the present invention is to provide a thread tension device which is capable of positively forming various shapes of stitches, such as an overedge stitch, a roll hemming stitch, and an ornamental stitch and the like by varying tension given to each sewing thread.

It is another object of the invention to provide a thread tension device which is adapted to move a regulating mechanism to render a spring elastic to vary tensile force applied to each thread threading through each thread tensioning disc.

It is still another object of the invention to provide a thread tension device which is compact and simple in structure and facilitate its operation.

These and other objects of the invention are accomplished by a thread tension device which includes a plurality of thread tensioning means corresponding to a number of sewing threads, and regulating means for varying tensile force applied to each thread engageable with each thread tensioning means, the thread tensioning means comprises a pair of thread tensioning discs slidably supported on, and axially of, a rotatable shaft, and spring means at its one end supported on a threadable spring holder movable on a sleeve and held at the other end against the other disc, the regulating means comprises a rotary member rotatable with the shaft, and a follower having one side abutted against the rotary member and the other side held against the other disc by means of the spring means, the follower being slidably supported on and axially of the shaft, either the rotary member or the follower being provided on either surface with projections, or forms with a rugged surface to engage with the projections.

A feature of the invention involves a shaft that is rotated to rotate the rotary member so that the rugged surface formed with the follower in contact with the rotary member and the rugged surface of the rotary member may cooperate with each other to move the follower.

Another feature of the invention is that a small surface is provided on which the members or parts slide, and the follower may be moved without any tilting so that no excessive power must be generated to turn the thread tension dial 3.

DETAILED DESCRIPTION OF THE DRAWINGS

Figure 1:
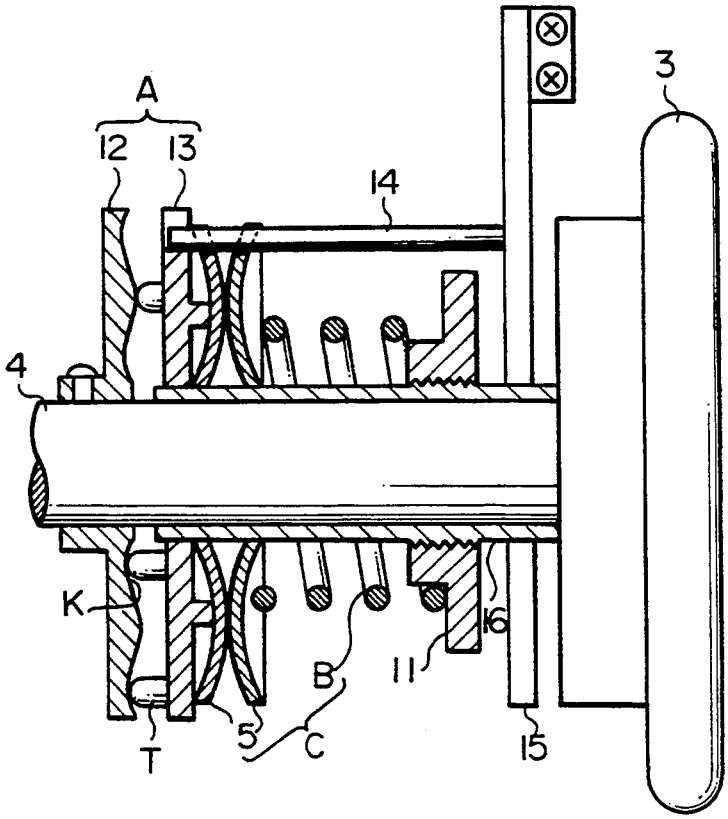
FIG. 1 is a sectional view of a thread tension device for an overlock sewing machine embodying the present invention.
Figure 2:
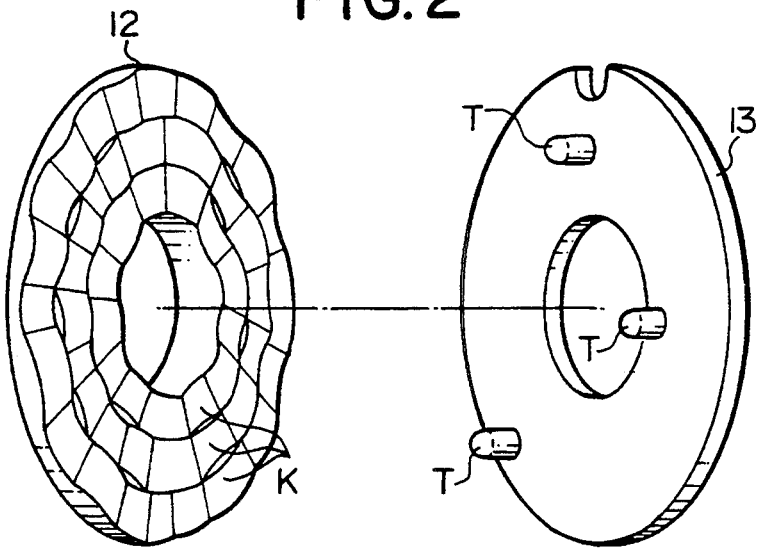
FIG. 2 is a perspective view showing a rotary member and a movable member or follower formed in the tension device for the overlock sewing machine shown in FIG. 1.
Figure 3:
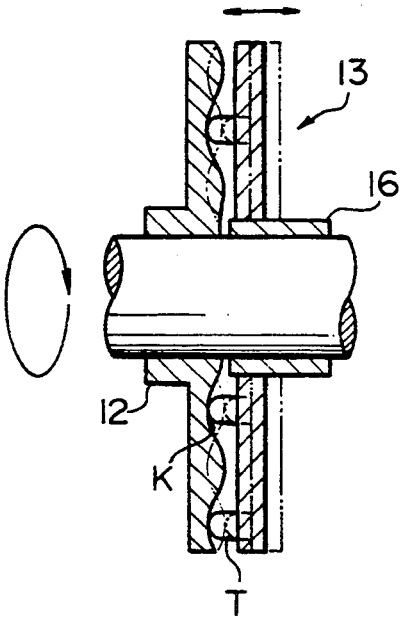
FIG. 3 is a sectional view showing the relationship between the rotary member and the follower.
Figure 4:
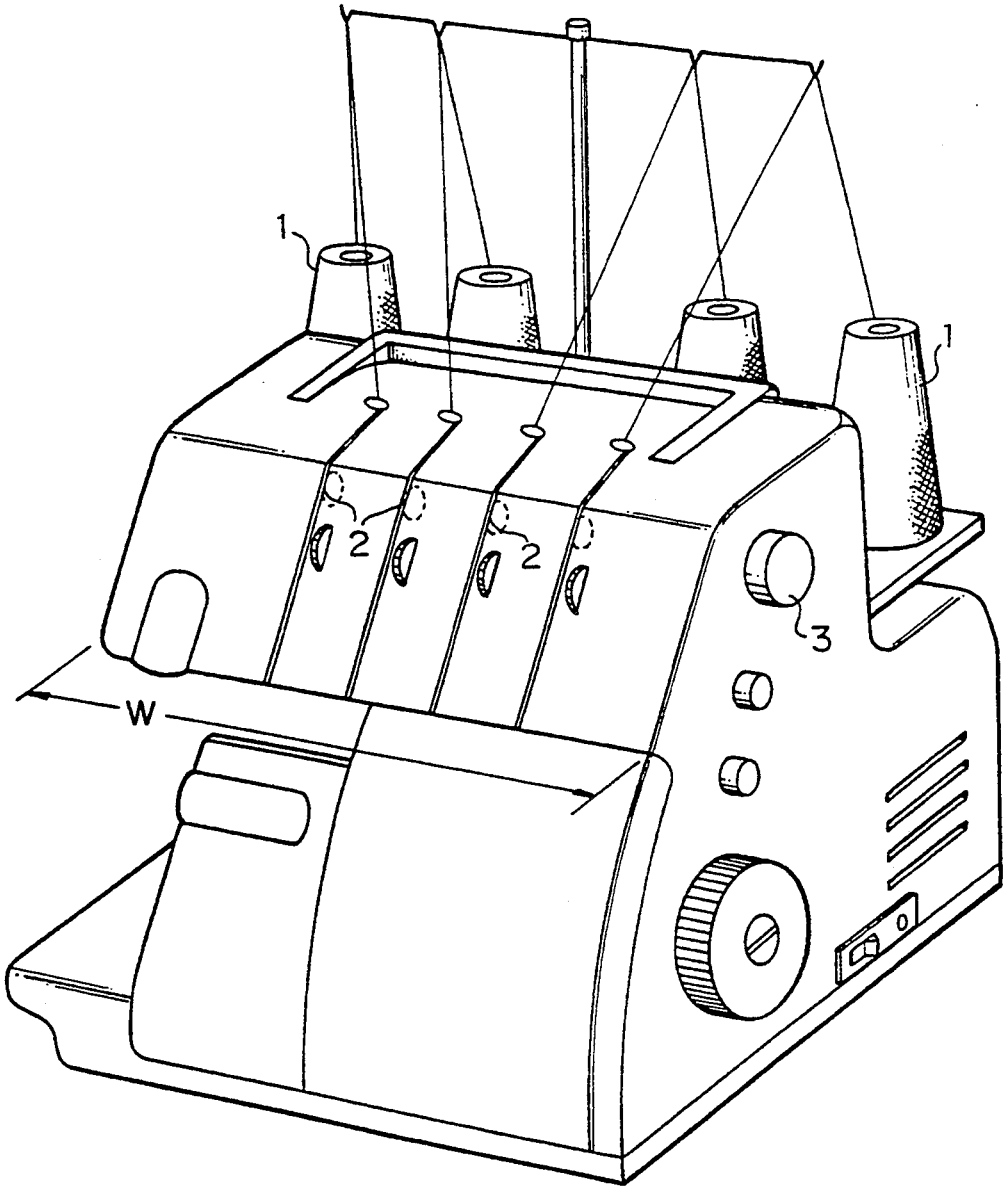
FIG. 4 Prior Art
FIG. 4 is a perspective view of the overlock sewing machine.
Figure 5:
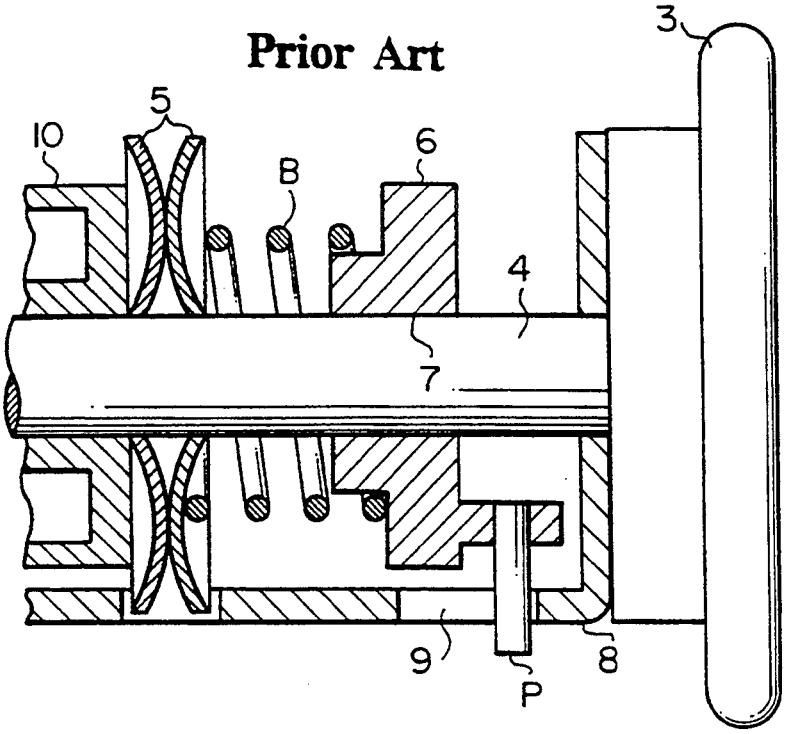
FIG. 5 Prior Art
FIG. 5 is a sectional view of a conventional thread tension device to be incorporated in the overlock sewing machine.

Referring now to the drawings, wherein like reference characters designate like or corresponding parts of a conventional thread tension device shown in FIG. 5. In FIGS. 1 through 3, a thread tension device for an overlock sewing machine is shown, which includes thread tensioning means C and regulator means A. Although the overlock sewing machine has a plurality of thread tension devices to positively receive a plurality of threads at adjustable tensions for sewing operation, each device is, however, identical so that it is deemed sufficient to describe only one. Thread tensioning means C comprises a pair of thread tension discs 5 and spring means B. Each of the thread tension discs 5 is adapted to engage a support pin 14 extended from a support element 15 fixed to a frame of the sewing machine. The support pin 14 is so supported as to be slidably moved axially of a shaft 4.

As shown, spring means B is adapted to abut its one end against a spring holder 11 and the other end against one of the thread tension discs 5 (right side of the thread tension disc in the drawing). The spring holder 11 is threadably moved on a sleeve 16 fixed to the support element 15 by rotating the thread tension dial 3.

A regulator means A comprises a rotary member 12 and a follower 13. The rotary member 12 is rigidly mounted to the shaft 4 and is rotatable therewith. The follower 13 is in turn slidably supported on the sleeve 16 but prevented by the support pin 14 from being rotated. The follower 13 has one side in contact with the other side of the other tension disc 5 (left side of the thread tension disc in the drawing) and the other side in abutment with the rotary member 12.

FIG. 2 shows the physical surface structure of both the rotary member 12 and the follower 13. The rotary member 12 has a rugged surface K in an annular form with annuluses spaced at different distances from each other with the axis of the shaft 4 as the center of the rotary member. The three projections T are radially arranged on one side of the follower 13 to abut against the rugged surface K. The follower 13 may be forwardly and rearwardly moved numerous times according to rotational angles formed by the rugged surface K. Each of the rugged surfaces of the rugged surface K are so configured as to snugly fit over each of the projections T of the follower 13 so that the follower 13 is forwardly and rearwardly moved in a proper manner without any tilting.

Although only one of the thread tension devices is shown in FIG. 2, it is noted that four thread tension devices are mounted on the shaft 4 in this instance, and that the respective rugged surfaces of the annular members are configured different from each other so as to apply tensile force optimum to the respective thread tension device. Although this embodiment of the invention has been described by the annular members K formed on the rotary member 12 and the projections T provided on the follower 13, the invention is not limited to this specified structure. The projections T may be formed on the rotary member 12 and the annular member K may be arranged on the follower 13.

The thread tension device arranged as aforementioned is operated to enable the operator of the sewing machine to readily change the force applied to the thread tensioning discs 5 by spring means B by rotating the thread tension dial 3, namely through forwardly moving the rotary member 12 and rearwardly moving the follower 13 by means of the rugged surface K.

Although the invention has been described by way of reference to the embodiments disclosed herein, it should be understood that the invention is not limited to the disclosed embodiments. Rather, the invention should be interpreted in accordance with the claims which follow.

What is claimed:

1. A thread tension device for a sewing machine, the thread tension device including a rotatably operable shaft, a pair of thread tensioning discs so disposed opposite to each other as to move axially with respect to said shaft, an elastic member mounted on said shaft so as to apply a pressure contact force to said thread tensioning discs, said thread tension device comprising:

a rotary member fixed to said shaft;

a follower movable in an axial direction only with respect to said shaft between said thread tensioning discs and said rotary member;

a cam surface formed on one of the opposed surfaces of either one of said rotary member or said follower; and a projection element formed on the other one of the opposed surfaces of either one of said rotary member or said follower so as to engage with said cam surface, said elastic member being provided to vary a contact force of said thread tensioning discs with an axial movement of said follower.

2. A thread tension device as claimed in claim 1, wherein said cam surface is a radially formed plural cam surface, and said projection element is a plural projection element adapted to oppose to each cam surface.

3. A thread tension device as claimed in claim 1, wherein said sewing machine is an overlock sewing machine.

* * * * *